United States Patent [19]

Downs

[11] 4,274,099

[45] Jun. 16, 1981

[54] RANDOM CONDUCTIVE ROVING REFLECTIVE SURFACING FOR ANTENNAS AND GUIDES

[76] Inventor: James W. Downs, 3917 Villanova, Dallas, Tex. 75225

[21] Appl. No.: 15,856

[22] Filed: Feb. 26, 1979

[51] Int. Cl.[3] ..... H01Q 15/14

[52] U.S. Cl. ..... 343/912; 156/245; 343/873

[58] Field of Search ..... 343/873, 872, 909, 755, 343/839, 840, 779, 912; 156/245

[56] References Cited

U.S. PATENT DOCUMENTS

| | | | |
|---|---|---|---|
| 2,841,786 | 7/1958 | Dicke | 343/909 |
| 2,948,896 | 8/1960 | Hart Jr. | 343/873 |
| 3,470,561 | 9/1969 | Horst | 343/911 R |

*Primary Examiner*—David K. Moore
*Attorney, Agent, or Firm*—Warren H. Kintzinger

[57] ABSTRACT

A radio frequency RF reflective surface of randomly deposited conductive roving lifted from the surface of a reflector mold after having been bonded with such as a polyester resin or epoxy resin. The roving in the form of a chopped element layer of fiberglass having a conductive material coating on the fiberglass is deposited from a chopper gun to cover an entire surface in the form desired for RF reflection and then, without interruption, non-conductive roving is used in the chopper gun to build up the necessary thickness and structural strength in the antenna with a bonding resin being simultaneously applied to fix the roving in place in the structure.

13 Claims, 4 Drawing Figures

RANDOM CONDUCTIVE ROVING REFLECTIVE SURFACING FOR ANTENNAS AND GUIDES

Figure 1:
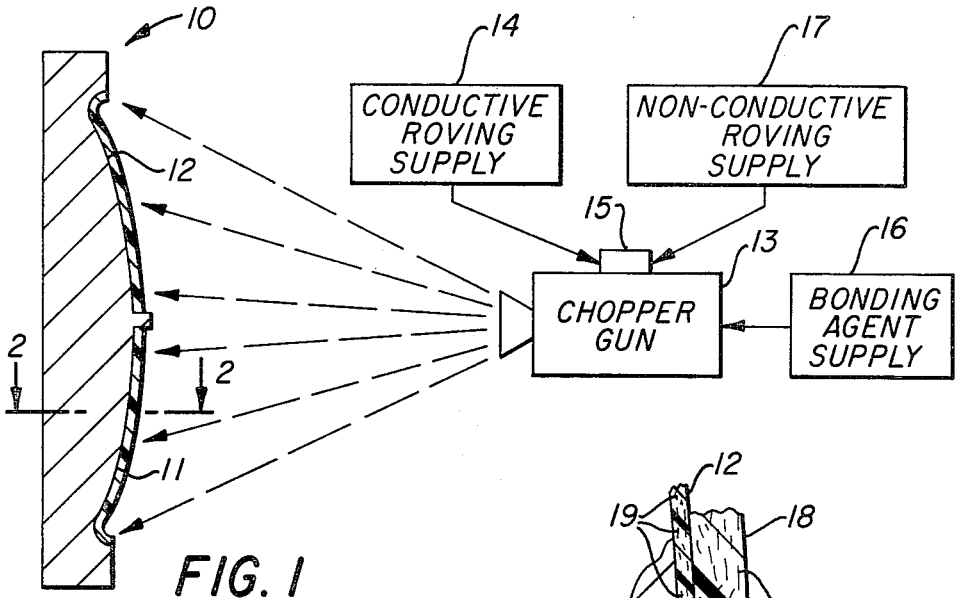

This invention relates in general to RF signal reflecting surfaces, and more particularly, to RF reflective surfaces of randomly deposited conductive chopped roving entrained in a bonding resin.

In many antenna dish type reflectors and RF reflective surface applications plastics would be desirable from a cost and workability standpoint along with having weight and structural advantages, particularly if antenna dish surfaces and other RF reflective surfaces could be made to present highly efficient RF reflective characteristics. In an attempt to provide plastics with electrical conductivity and RF reflective surfaces they have been painted with silver paint, flame-sprayed with aluminum or zinc, filled with carbon or metal particles, without desired levels of success. Generally, surface coatings are expensive and easily damaged, metal particle fillings degrade the plastic structural strength and impact resistance, and carbon fillings make the plastic combination black. In a significant step forward conductive roving entrained in a bonding resin is excellent in providing desired RF signal reflective surface characteristics. The conductive roving may be chopped into any desired convenient length and sprayed, or laid, on the surface of the reflector mold and bonded in position and shape with a resin such as polyester or epoxy. In addition to conductivity, not only electrical but thermal as well, and reflective properties the conductive roving also contributes from a structural standpoint since it has the strength of ordinary glass roving. Conductive roving can be applied through a standard chopper gun in the same way nonconductive roving can be made into matting similar to ordinary fiberglass matting for applications not suited to use of a chopper gun. This could be applicable with respect to small size reflectors where use of conductive matting is more practical than use of a chopper gun on such small items. It appears that particularly advantageous applications for use of chopped conductive glass roving is in the fabrication of fairly large reflective antennas and sub-reflectors for use in microwave communications and radar. The conductive roving reflective surface is an excellent replacement for flame-spray coated surfaces that have been widely used as a reflective surface in many microwave antennas. It is interesting to note that advantages in use of conductive roving as opposed to flame-spray coating include, that only a chopper gun is required for both roving with resin reflective surface and structure whereas flame-sprays that are as expensive as chopper guns are used only for the flame spray coating of surfaces. Further, a roving chopper gun can accomplish in minutes what a flame-spray unit takes hours to accomplish. Even further, superior reflectivity is obtained with the conductive roving especially at the high end of the frequency spectrum.

While resin to glass ratio in most chopper gun lay-ups is about 70/30 it is desirable, in some applications, especially small RF reflectors and waveguide transitions, to use a vacuum bag and run excess resin out and compact the fibers to advantageously increase the ratio of fibers to resin in such applications.

It is therefore a principal object of this invention to provide a highly effective RF reflective surface in a structure having light weight and structural advantages.

Another object is to provide such a RF reflective surface equipped antenna in a low cost yet effective structure.

A further object is to provide such an antenna structure that is quickly and effectively constructed with chopper gun deposited conductive roving entrained in resin deposited reflective surface shaped by the desired antenna dish mold.

Features of the invention useful in accomplishing the above objects include, in a randomly deposited conductive roving RF reflective surfacing for antennas and guides, conductive material coated fiberglass roving chopped into short lengths deposited on desired mold form surfaces and entrained in a bonding agent such as a resin of polyester or epoxy simultaneously applied. The conductive roving layer forming an RF reflective surface with excellent reflective characteristics is backed up by ordinary nonconductive glass roving, also applied by chopper gun simultaneously applying additional bonding agent. Ordinary fiberglass matting is used as an alternate to nonconductive glass roving in some applications where it is not appropriate to use a chopper gun. This is particularly so with small size RF reflectors since it is impractical to use a chopper gun on small items. Both the conductive roving in a reflective surface layer, or in a structure using conductive roving throughout the body of the structure, and nonconductive roving or fiberglass matting backing a conductive roving reflective surface layer all entrained in a bonding agent contribute as part of a structure relatively strong and rigid yet relatively light in weight in addition to the excellent conductive, both electrical and thermal, and RF reflective properties of conductive roving.

A specific embodiment representing what is presently regarded as the best mode of carrying out the invention is illustrated in the accompanying drawing.

Figure 2:
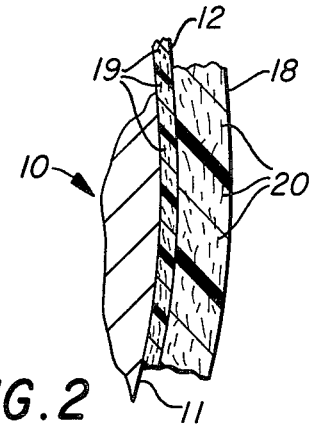
Figure 3:
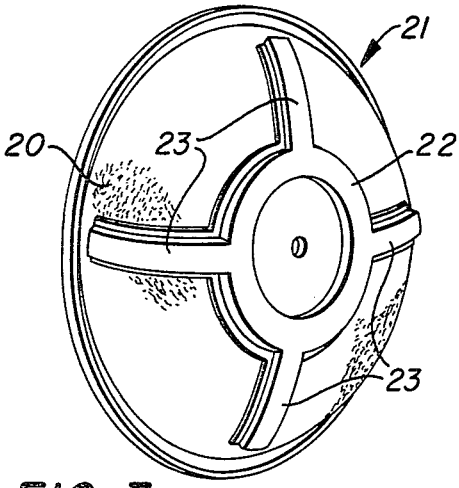
Figure 4:
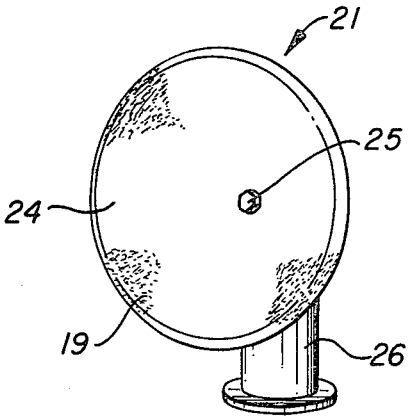

In the drawing:

FIG. 1 represents, partially in block schematic, and with a mold form in section, a system for the application of conductive roving and then nonconductive roving along with simultaneously applied bonding agent to form an RF signal reflective surface equipped structure;

FIG. 2, an enlarged partial sectioned view generally along line 2—2 of FIG. 1 showing embedded roving entrained in bonding agent;

FIG. 3, a rear perspective view of an antenna dish structure built of roving entrained in resin; and FIG. 4, a front perspective view of antenna dish structure mounted on a pedestal with an indication of entrained conductive roving in the RF reflective face surface of the dish.

Referring to the drawing:

The mold 10 in FIG. 1 having an antenna dish forming face 11 is shown as receiving thereon conductive roving in a layer 12 from chopper gun 13 that effectively chops the conductive roving supplied from conductive roving supply source 14 through roving supply control valve 15. The chopper gun also effectively simultaneously feeds from bonding agent supply 16 a bonding agent such as a resin polyester or epoxy sufficient to effectively bond the conductive roving layer formed on the mold face 11 and result in a smooth reflective face with the chopped conductive roving bonded together. Subsequently, after sufficient conductive roving and bonding agent 16 have been deposited for the initial reflective layer 12, valve 15 may be switch controlled for supply of nonconductive roving from nonconductive roving supply 17 to build up a structural backing thickness of combined nonconductive roving and bonding agent material such as a resin, again of either polyester or epoxy.

With reference also to FIG. 2, the structural layer 18 of nonconductive roving in structural form bonded with a resin is shown to be built up to substantially greater thickness than the reflective layer of conductive roving 12. Please note that the conductive roving is cut via the chopper gun 13 into relatively short fiber lengths, with, in some instances, a fiber length being controlled to optimize RF signal reflection in certain frequency ranges of operation. Nonconductive chopped roving elements 20 may span a greater range in length and quite adequately fulfill structural requirements in the resin bonded structure.

The perspective view of FIG. 3 shows the nonconductive roving entrained plastic structural rear of an antenna dish 21 with stiffening framing 22 and ribs 23.

In referring to FIG. 4 the reflective face 24 of the antenna dish 21 with a bolt 25 center fastening thereof to pedestal structure 26 is shown along with chopped conductive roving fibers 19 entrained within the resin bonding agent forming the relative surface 24.

While conductive roving can be handled through a standard chopper gun in exactly the same way nonconductive roving is used, it can also be made into a mat similar to ordinary fiberglass matting for use in applications where it is not appropriate to use a chopper gun. This proves useful when conductive roving is to be used with epoxy not useable with a chopper gun. Further, conductive roving may be chopped and blown onto a surface of ordinary glass cloth with a binder included to hold the chopped conductive roving fibers together and to the glass cloth. Then as soon as the binder (lacquer or similar solvent based binder that will dissolve in liquid resin during the lamination process upon use) has dried the composite of glass cloth and conductive roving is rolled up ready for use. With the use of woven glass cloth it is possible to use only enough conductive roving to provide ultimately an RF reflecting surface having desired performance characteristics when the material is finish processed. This woven glass cloth holds together with the conductive roving thereon during cutting and laminating as conventional mat fabricating techniques are employed.

The main application for chopped conductive glass roving would be in the fabrication of fairly large reflective antennas and sub-reflectors for use in microwave communications and radar with the RF reflective surfaces provided thereby replacing, for example, flame-spray surfaces commonly used as a reflective surface on many microwave antennas. In some applications (especially small reflectors and waveguide transitions) it is desirable to use a vacuum bag and to run excess resin out to compact the fibers and increase the ratio of fibers to resin.

Whereas this invention has been described with respect to several embodiments thereof, it should be realized that various changes may be made without departing from the essential contributions to the art made by the teachings hereof.

I claim:

1. In a RF signal reflective surface equipped structure: conductive roving element lengths randomly positioned and held in place by bonding agent means; with said conductive roving element lengths with said bonding agent means having a molded surface in the selected RF signal reflective surface shape; and wherein said conductive roving element lengths are cut lengths of conductive material coated fiberglass fibers randomly deposited to desired density in a layer of conductive roving enclosed in said bonding agent means.

2. The RF signal reflective surface equipped structure of claim 1, wherein said bonding agent means is a resin material.

3. The RF signal reflective surface equipped structure of claim 1, wherein said layer of conductive roving in bonding agent means has a surface face molded to an RF antenna reflector shape.

4. The RF signal reflective surface equipped structure of claim 3, wherein said layer of conductive roving in bonding agent means is backed by built-up structural means.

5. The RF signal reflective surface equipped structure of claim 4, wherein said built-up structural means includes, fiberglass enclosed in bonding agent means in a stiffening and structural support layer.

6. The RF signal reflective surface equipped structure of claim 5, wherein said fiberglass is in the form of chopped nonconductive roving randomly deposited.

7. The RF signal reflective surface equipped structure of claim 5, wherein said fiberglass is in laminated matting form.

8. The RF signal reflective surface equipped structure of claim 5, wherein said fiberglass is in the form of fiberglass woven cloth.

9. The RF signal reflective surface equipped structure of claim 1, wherein said layer of conductive roving in bonding agent means is backed by built-up structural means.

10. The RF signal reflective surface equipped structure of claim 9, wherein said built-up structural means includes, fiberglass enclosed in bonding agent means in a stiffening and structural support layer.

11. The RF signal reflective surface equipped structure of claim 10, wherein said fiberglass is in the form of chopped nonconductive roving randomly deposited.

12. The RF signal reflective surface equipped structure of claim 10, wherein said fiberglass is in laminated matting form.

13. The RF signal reflective surface equipped structure of claim 10, wherein said fiberglass is in the form of fiberglass woven cloth.

* * * * *